United States Patent [19]

Morchower

[11] Patent Number: 4,960,233

[45] Date of Patent: Oct. 2, 1990

[54] CARRYING BAG ASSEMBLY

[75] Inventor: Harry S. Morchower, Dallas, Tex.

[73] Assignee: Dallas Handbag Company, Dallas, Tex.

[21] Appl. No.: 447,007

[22] Filed: Dec. 6, 1989

[51] Int. Cl.[5] ..... A45F 3/14

[52] U.S. Cl. ..... 224/250; 150/106; 294/141; 379/441; 455/100

[58] Field of Search ..... 224/218, 250, 242; 379/110, 441, 447, 450, 454–456; 150/106 X, 110; 190/1, 109, 111, 900; 383/41, 66, 127; 294/141; 128/201.19; 455/100

[56] References Cited

U.S. PATENT DOCUMENTS

| | | | |
|---|---|---|---|
| 2,560,320 | 7/1951 | Winkler | 455/349 |
| 2,984,740 | 5/1961 | Madland et al. | 455/349 |
| 3,824,465 | 7/1974 | Blough | 455/90 |
| 4,677,654 | 6/1987 | Lagin et al | 455/90 |
| 4,790,417 | 12/1988 | Kawa et al. | 190/112 |

FOREIGN PATENT DOCUMENTS

| | | | |
|---|---|---|---|
| 1248513 | 11/1960 | France | 150/106 |

OTHER PUBLICATIONS

"Basic Theory and Application of Transistors"–Army Tech–Manual 1959 (p. 4), class 455, sub 100 (TM 11–690; Mar. 1959).

Mar. 1954–Electronics, Industry Report–"Production Underway on Air Force UHF Set", (p. 24), class 455, sub 100.

*Primary Examiner*—Henry J. Recla

*Assistant Examiner*—Keith Kupferschmid

*Attorney, Agent, or Firm*—Timmons & Kelly

[57] ABSTRACT

A carrying bag assembly having a carrying bag for carrying personal items and a telephone receiver/transmitter unit attached to the carrying bag. The receiver/-transmitter unit can be connected to a telephone line by means of a wire with a plug on one end. A telephone handset is attached to the receiver/transmitter unit by means of a cord. The handset can be attached to the handle of the carrying bag by two pieces of material that wrap around the handset and attach to one another. A keypad is located on the outer surface of the carrying bag for dialing the telephone.

6 Claims, 1 Drawing Sheet

CARRYING BAG ASSEMBLY

BACKGROUND OF THE INVENTION

1. Field of the Invention

This invention relates in general to carrying bags and to telephones. In particular, the invention relates to carrying bags having built-in telephones.

2. Description of the Prior Art

Communications technology has progressed rapidly in recent years, to a point where telephone receiver/-transmitter units have become extremely portable and light-weight. However, portable telephones have not been designed to be easily carried when not in use.

It has been known to combine telephones with other pieces of equipment, such as computers, facsimile machines, and photocopy machines. These various combinations have lacked the capability of storing a quantity of personal items, such as the items commonly carried in purses or handbags.

There remained a need for a carrying bag for personal items, which also included a portable telephone. Such a combination would provide space for carrying personal items, and would also provide convenient communications capability.

SUMMARY OF THE INVENTION

The carrying bag of the invention provides abundant storage space for personal items. The carrying bag also includes a telephone includes a carrying bag for holding a quantity of personal items. A telephone receiver/-transmitter unit is attached to the carrying bag.

Connecting means is provided for connecting the receiver/transmitter unit to a telephone line. The connecting means may be a wire with a plug on one end, or an antenna.

A telephone cord attaches a telephone handset to the receiver/transmitter unit. When the handset is not in use, the handset may be attached to a handle on the carrying bag. The attachment means for attaching the handset to the handle of the carrying bag may be two pieces of material. The two pieces of material are connected to the handle and wrap around the handset to secure the handset to the handle of the carrying bag.

DESCRIPTION OF THE PREFERRED EMBODIMENT

Figure 1:
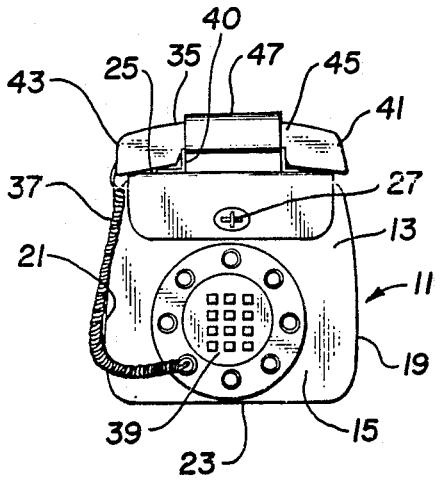
FIG. 1 is a front view of the carrying bag of the invention.
Figure 2:
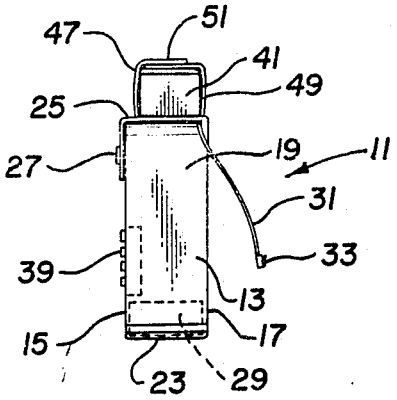
FIG. 2 is a side of the carrying bag of the invention.

The carrying bag assembly of the invention may include a handbag, a backpack, a purse, a tote bag, or any of many different types of carrying bags for personal items. One preferred embodiment, as shown in FIGS. 1 and 2, is purse 11. The purse 11 includes a carrying bag 13, having a front 15, a back 17, two sides 19 and 21, and a bottom 23. The bag 13 also has a top 25 that is attached to the back 17 and folds down over the front 15 of the bag 13. A clasp 27 mounted on the front 15 of the bag 13 extends through a hole in the top 25 to secure the top 25 in a closed position.

A telephone receiver/transmitter unit 29 is located inside and attached to the carrying bag 13. The receiver/transmitter unit 29 is connected to a telephone line by a connecting means that in the preferred embodiment is a wire 31 with a plug 33 on the distal end. The plug can be plugged into any standard telephone socket to connect the receiver/transmitter unit 29 to a telephone line. Another connecting means might be an antenna, such as is used in wireless telephone units.

A telephone handset 35 is attached to the receiver/-transmitter unit 29 by means of a cord 37. In the preferred embodiment, shown in FIGS. 1 and 2, the cord 37 extends from one end of the handset 35 to the front 15 of the bag 13. The cord 37 passes through the front 15 of the bag 13 to the receiver/transmitter unit 29.

A telephone keypad 39 is mounted on the outer surface of the front 15 of the carrying bag 13, and is connected to the receiver/transmitter unit 29 for providing a means for dialing the telephone. The keypad 39 could alternatively be located on the handset 35 or elsewhere on the bag 13.

A handle 40 is attached to the top 25 of the bag 13 to facilitating carrying of the bag 13. The handset 35 has an earpiece 41 and a mouthpiece 43, separated by a grip 45. The telephone handset 35 can be laid across the handle 40, with the earpiece 41 and the mouthpiece 43 of the handset 35 on opposite ends of the handle 40. The grip 45 of the handset 35 is thus located adjacent to the handle 40 of the bag 13.

The handset 35 can be attached to the handle 40 of the bag 13 with attachment means that includes two pieces of material 47 and 49 connected to the handle 40. The two pieces of material 47 and 49 wrap around the grip 45 of the handset 35 in opposite directions, as shown in FIG. 2. The two pieces of material 47 and 49 are secured together by connectors, such as snaps or loop and pile connectors 51.

When the telephone is not in use, the handset 35 is secured to the handle 40 of the carrying bag 13 by the two pieces of material 47 and 49. The carrying bag 13 can then be easily carried by gripping the handle 40.

In order to use the telephone, the plug 33 is plugged into a standard telephone line socket. The two pieces of material 47 and 49 are released and the handset 35 is removed from the handle 40. The keypad 39 is then used to dial a desired number.

The carrying bag 13 of the invention has several advantages over the prior art. The bag 13 provides adequate room for personal items. The telephone is conveniently located for easy use, and yet the telephone can be easily carried even when not in use.

The invention has been shown in only one embodiment. It should be apparent to those skilled in the art that the invention is not so limited, but is susceptible to various changes and modifications without departing from the spirit of the invention.

I claim:

1. A carrying bag assembly, comprising:

a carrying bag having an interior chamber for holding personal items;

a telephone receiver/transmitter unit attached to the carrying bag;

connecting means for connecting the receiver/transmitter unit to a telephone line;

a telephone handset;

a cord for attaching the handset to the receiver/transmitter unit;

attachment means for attaching the handset to the exterior of the carrying bag; and dialing means mounted on the outer surface of the carrying bag for dialing the telephone.

2. A carrying bag assembly as defined in claim 1, wherein the dialing means comprises a keypad located on the outer surface of the carrying bag for dialing the telephone.

3. A carrying bag assembly as defined in claim 1, wherein the connecting means for connecting the receiver/transmitter unit to a telephone line is a wire and a plug on one end of the wire.

4. A carrying bag assembly as defined in claim 1, further comprising a handle attached to the carrying bag, wherein the attachment means for attaching the handset to the carrying bag attaches the handset to the handle of the carrying bag.

5. A carrying bag assembly as defined in claim 4, wherein the attachment means for attaching the handset to the carrying bag is two pieces of material, connected to the handle, wherein the two pieces of material wrap around the handset and attach to one another to secure the handset to the handle of the carrying bag.

6. A carrying bag assembly, comprising:

a carrying bag for holding personal items;

a telephone receiver/transmitter unit attached to the carrying bag;

a wire and a plug on one end of the wire for connecting the receiver/transmitter unit to a telephone line;

a telephone handset;

a cord for attaching the handset to the receiver/transmitter unit;

a handle attached to the carrying bag;

two pieces of material, connected to the handle, for attaching the handset to the handle of the carrying bag, wherein the two pieces of material wrap around the handset and attach to one another; and a keypad located on the outer surface of the carrying bag for dialing the telephone.

* * * * *